US012595650B2

(12) United States Patent
Jiang et al.

(10) Patent No.: US 12,595,650 B2
(45) Date of Patent: Apr. 7, 2026

(54) OUTDOOR TO INDOOR SWIMMING POOL APPARATUS

(71) Applicant: A&C FUTURE, INC., Newport Beach, CA (US)

(72) Inventors: Xunmin Jiang, Irvine, CA (US); Sichen Li, Santa Ana, CA (US); Zhuangboyu Zhou, Santa Ana, CA (US); Jiuqi Wang, Santa Ana, CA (US); Shoue Chen, Irvine, CA (US); Ju Gao, Newport Beach, CA (US); Pengcheng Wang, Irvine, CA (US); Han Qin, Newport Beach, CA (US); Jiayang Qin, Newport Beach, CA (US)

(73) Assignee: A&C FUTURE, INC., Irvine, CA (US)

( * ) Notice: Subject to any disclaimer, the term of this patent is extended or adjusted under 35 U.S.C. 154(b) by 392 days.

(21) Appl. No.: 18/175,940

(22) Filed: Feb. 28, 2023

(65) Prior Publication Data

US 2024/0287790 A1 Aug. 29, 2024

(51) Int. Cl.

| | |
|---|---|
| ***E04B 1/343*** | (2006.01) |
| ***E04B 1/344*** | (2006.01) |
| ***E04H 4/08*** | (2006.01) |

(52) U.S. Cl.

CPC ..... *E04B 1/34384* (2013.01); *E04B 1/3445* (2013.01); *E04H 4/086* (2013.01)

(58) Field of Classification Search

CPC .... E04B 1/34384; E04B 1/3445; E04H 4/086
USPC ..... 52/66
See application file for complete search history.

(56) References Cited

U.S. PATENT DOCUMENTS

| | | | | |
|---|---|---|---|---|
| 3,415,260 | A * | 12/1968 | Hall | E04H 15/52 52/63 |
| 3,501,783 | A * | 3/1970 | Broadman | E04H 4/086 4/500 |
| 3,683,427 | A | 8/1972 | Burkholz et al. | |
| 4,051,638 | A | 10/1977 | Heintz | |
| 4,246,663 | A | 1/1981 | Aragona et al. | |
| 4,598,506 | A * | 7/1986 | Nohl | E04H 4/084 254/387 |
| 4,683,686 | A | 8/1987 | Ozdemir | |
| 4,876,828 | A * | 10/1989 | Brill | E04B 1/3205 52/66 |
| 5,148,646 | A | 9/1992 | Lutostanski | |
| 6,065,252 | A * | 5/2000 | Norsen | E06B 3/80 52/6 |
| 6,212,702 | B1 | 4/2001 | Sitzmann | |
| 8,701,356 | B2 * | 4/2014 | Forsland | E04B 7/166 52/79.5 |
| 9,140,014 | B2 * | 9/2015 | Castel | E04B 1/19 |

(Continued)

*Primary Examiner* — James J Buckle, Jr.
(74) *Attorney, Agent, or Firm* — INNOVATION CAPITAL LAW GROUP, LLP; Vic Lin

(57) ABSTRACT

A foldable enclosure can turn an outdoor spa or swimming pool into its indoor counterpart, allowing the pool or spa to be used when the outdoor temperature is cold or when the weather is bad. An expandable room-like structure can cover the pool or spa in the back yard of the house. When the structure is not used, it can be retracted so it does not occupy much space in the house or in the back yard. The enclosure can include a sliding cover that can be used to cover up the pool and to allow people to walk on it. The expandable structure includes a sliding outer wall, two rotating side walls, a sliding wall seal, and several roof blocks.

19 Claims, 10 Drawing Sheets

(56) References Cited

U.S. PATENT DOCUMENTS

| | | | | |
|---|---|---|---|---|
| 9,394,709 | B2 * | 7/2016 | Losim | E04H 4/084 |
| 9,797,126 | B2 * | 10/2017 | Saggese | E04B 1/34305 |
| 9,797,156 | B2 * | 10/2017 | Neumann | E04H 15/505 |
| 2003/0014927 | A1 | 1/2003 | Brooks | |
| 2008/0282460 | A1 | 11/2008 | Del Valle | |
| 2009/0308422 | A1 | 12/2009 | Rizzotto | |
| 2011/0179565 | A1 | 7/2011 | Thibeault | |
| 2011/0225902 | A1 * | 9/2011 | Pouthe | B61D 39/002 52/64 |
| 2016/0069062 | A1 * | 3/2016 | Dynon | E04B 1/34336 52/79.5 |
| 2024/0279949 | A1 * | 8/2024 | Smetana | E04H 4/086 |

* cited by examiner

OUTDOOR TO INDOOR SWIMMING POOL APPARATUS

BACKGROUND OF THE INVENTION

1. Field of the Invention

Embodiments of the invention relate generally to movable enclosure structures. More particularly, embodiments of the invention relate to a structure that can be retracted against a building, such as a home, and expanded to cover a swimming pool, spa, or the like.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Swimming pools and spas are often placed directly behind a home to provide ease of access to people that live in the home. Swimming pools and spas are often uncovered, or, at best, covered within a screen room or small gazebo, for example. Such coverings do not provide protection from the weather, such as wind, rain, or even cold temperatures. If such coverings are provided to provide these protections, they are often bulky and permanently fixed in place.

In view of the foregoing, there is a need for a cover for a poo or spa that may be movable between retracted and expanded positions.

SUMMARY OF THE INVENTION

Embodiments of the present invention aim to solve the aforementioned problems in conventional pool enclosures by providing a pool enclosure that may be extended or retracted depending on the user's desire for a cover or for an uncovered pool area.

Embodiments of the present invention provide a foldable enclosure extendable from a structure comprising an outer wall slidable away from the structure to move the outer end wall into an expanded state; first and second side walls, pivotably attached at the structure, the first and second side walls mating with the outer end wall in the expanded state; and a roof, disposed to cover at least a portion of a front face of the outer end wall in a folded state, the roof moving to cover an interior of the foldable enclosure as the outer end wall is moved away from the structure toward the expanded state.

Embodiments of the present invention provide a foldable enclosure extendable from a structure to enclose a pool or spa, comprising an outer wall slidable away from the structure to move the outer end wall into an expanded state; first and second side walls, pivotably attached at the structure, the first and second side walls mating with the outer end wall in the expanded state; a roof, disposed to cover at least a portion of a front face of the outer end wall in a folded state, the roof moving to cover an interior of the foldable enclosure as the outer end wall is moved away from the structure toward the expanded state; and a floor sealing member extendable from the structure, the floor sealing member providing a seal between a surface and the outer wall and the first and second side walls, wherein the outer wall includes first and second tracks, each extending vertically along opposing sides of the outer wall, the first and second tracks extending along extension arms extending rearward from a front of the outer wall.

Embodiments of the present invention provide a foldable enclosure extendable from a structure to enclose a pool or spa, comprising an outer wall slidable away from the structure to move the outer end wall into an expanded state; first and second side walls, pivotably attached at the structure, the first and second side walls mating with the outer end wall in the expanded state; a roof, disposed to cover at least a portion of a front face of the outer end wall in a folded state, the roof moving to cover an interior of the foldable enclosure as the outer end wall is moved away from the structure toward the expanded state; a floor sealing member extendable from the structure, the floor sealing member providing a seal between a surface and the outer wall and the first and second side walls; and a pool cover extendable from the structure to form a floor surface over the pool or spa, adjacent the structure, to permit users to walk on the floor surface when not using the pool or spa.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1A:
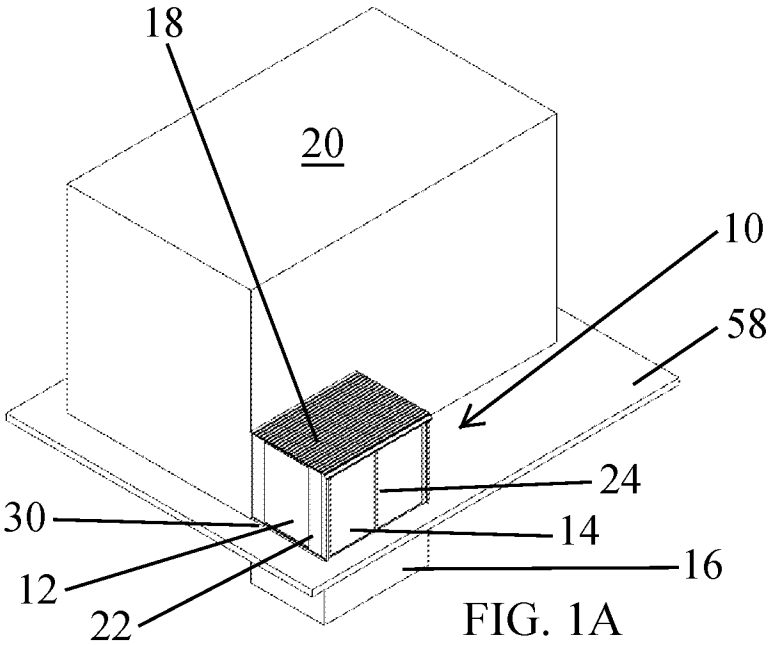
FIG. 1A illustrates a perspective view of a pool enclosure for covering a pool at a home, in an expanded state, according to an exemplary embodiment of the present invention.
Figure 1D:
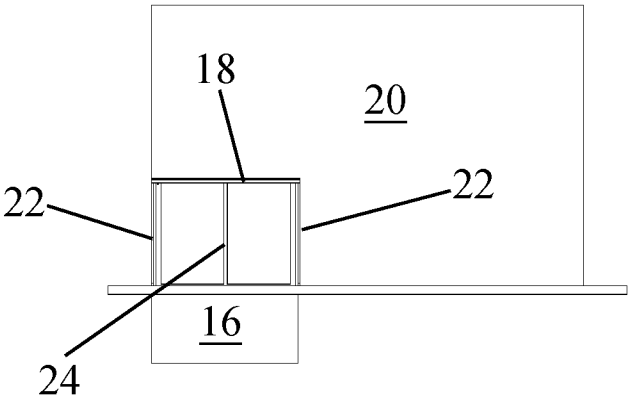
FIG. 1D illustrates a front view of the pool enclosure of FIG. 1A.
Figure 1B:
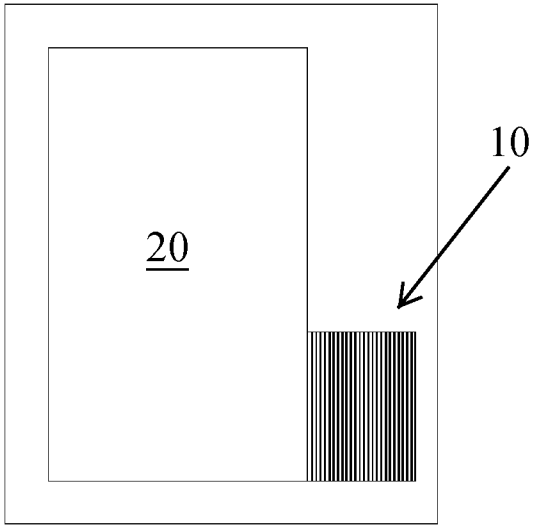
FIG. 1B illustrates a top view of the pool enclosure of FIG. 1A.
Figure 1C:
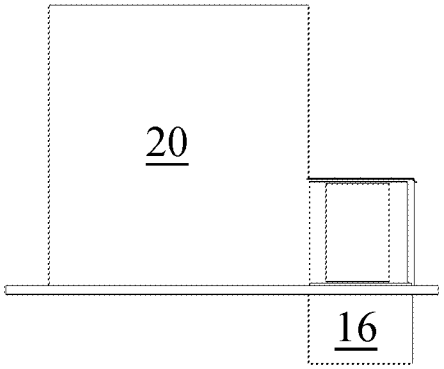
FIG. 1C illustrates a side view of the pool enclosure of FIG. 1A.
Figure 2A:
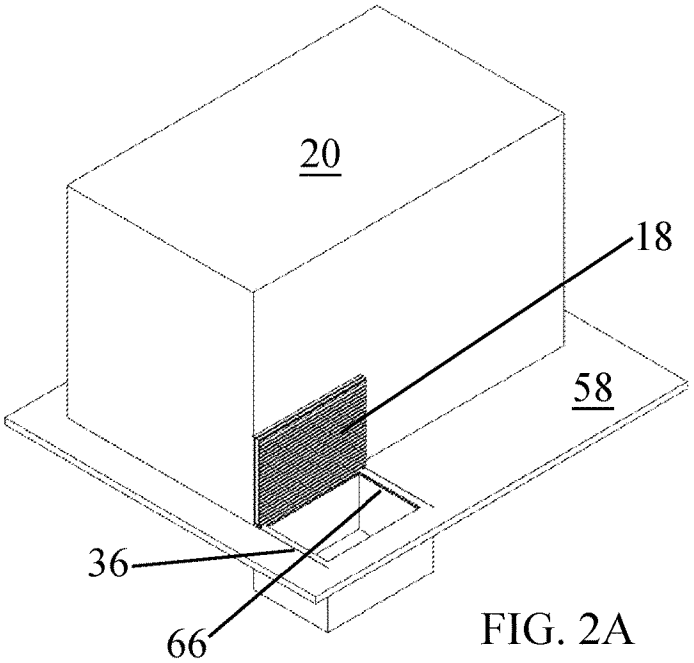
FIG. 2A illustrates a perspective view of a pool enclosure for covering a pool at a home, in a retracted state, according to an exemplary embodiment of the present invention.
Figure 2D:
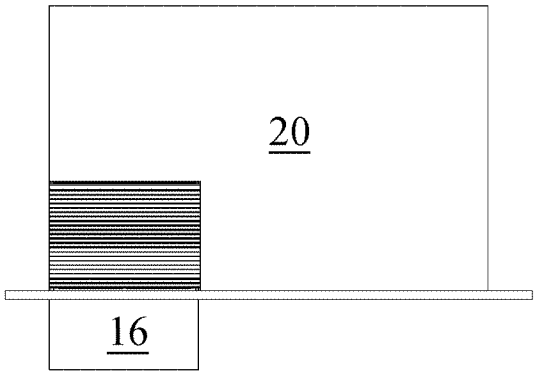
FIG. 2D illustrates a front view of the pool enclosure of FIG. 2A.
Figure 2B:
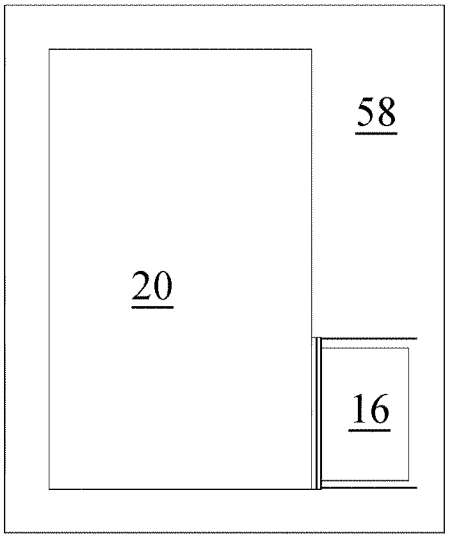
FIG. 2B illustrates a top view of the pool enclosure of FIG. 2A.
Figure 2C:
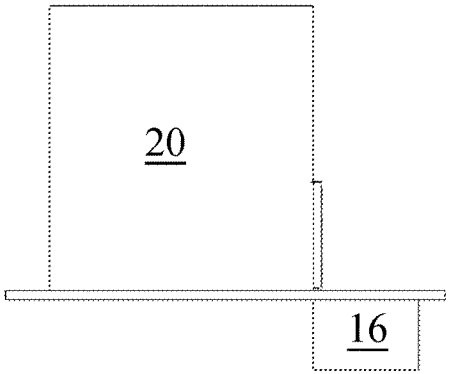
FIG. 2C illustrates a side view of the pool enclosure of FIG. 2A.
Figure 3A:
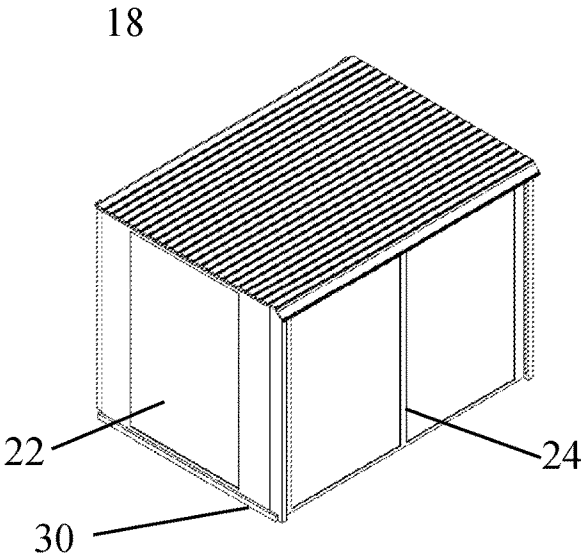
FIG. 3A illustrates a perspective view of a pool enclosure for covering a pool, with the home structure removed for clarity, in an expanded state, according to an exemplary embodiment of the present invention.
Figure 3D:
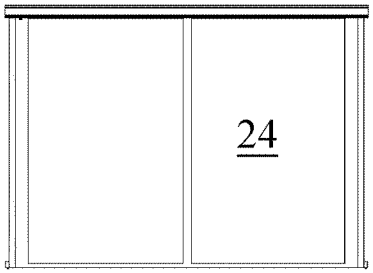
FIG. 3D illustrates a front view of the pool enclosure of FIG. 3A.
Figure 3B:
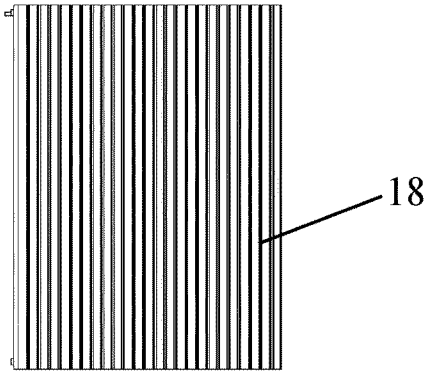
FIG. 3B illustrates a top view of the pool enclosure of FIG. 3A.
Figure 3C:
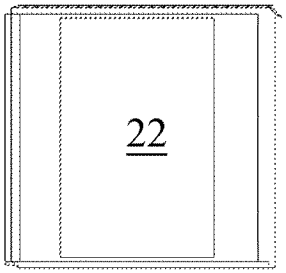
FIG. 3C illustrates a side view of the pool enclosure of FIG. 3A.

The illustrations in the figures may not necessarily be drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a mechanism for turning an outdoor spa or swimming pool into its indoor counterpart, allowing the pool or spa to be used when the outdoor temperature is cold or when the weather is bad. The mechanism uses an expandable room like structure to cover the pool or spa in the back yard of the house. When the structure is not used, it can be retracted so it does not occupy much space in the house or in the back yard. The mechanism can include a thick sliding cover that can be used to cover up the pool and to allow people to walk on it. The expandable structure includes a sliding outer wall, two rotating side walls, a sliding wall seal, and several roof blocks.

This design aims to allow the user to have a more versatile swimming pool or spa in their back yard. It allows the user to include the pool within an enclosure without wasting much space in their place. It also allows the user to enjoy their pool on more occasions. The cover on the pool allows the user to increase the area available in the backyard when guests are present and the pool is not in use.

The figures are briefly described below, followed by a broader discussion of each figure and the components therein.

FIGS. 1A through 2D provide overview of the entire structure. The enclosure structure includes the moving structure and mechanism that allows the pool to be covered. The structure includes an outer wall that can be extended or retracted. When the wall is retracted, the roof blocks can rest on the front of the wall, serving as a cover. When the structure is extended, the roof block can automatically be pulled up, as the topmost block can be connected to the house, and serve as a roof for the enclosure. When the outer wall is extended, the side walls can then rotate to enclose the entire structure. The side of the pool can include two rails for the wheels on the floor seal to move along, as described below.

FIGS. 3A through 5 show more detailed views of the covering structure when it is extended. The structure includes two side rotatable walls, one outer wall that has a rail for the roof blocks, several roof blocks, and a floor seal that helps cover the gap between the walls and the floor near the pool.

FIGS. 6A through 6D show one of the plurality of roof block. The roof block can be mounted onto the rail on the outer wall using a shaft that runs through the roof block. The angled shape can help the roof block to move past the 90 degree turn (from being disposed on the front of the retracted structure, to being disposed on the top of the expanded structure) without interfering with each other. The top part of the roof block can extend on both sides to serve as an overhang and prevent water from leaking in when raining.

FIGS. 7A through 7D show a detailed view of the outer wall. There are notches on the side of its inner surface to help provide support to the side rotatable walls and prevent rain from leaking in, as described in greater detail below.

FIG. 8A through 8D show the side rotatable wall. When retracted, the side walls are oriented horizontally, generally co-planar with the home structure and can be stored against or inside the house. The side walls can be placed behind the outer wall that serves as the cover when in the retracted state.

Figure 9:
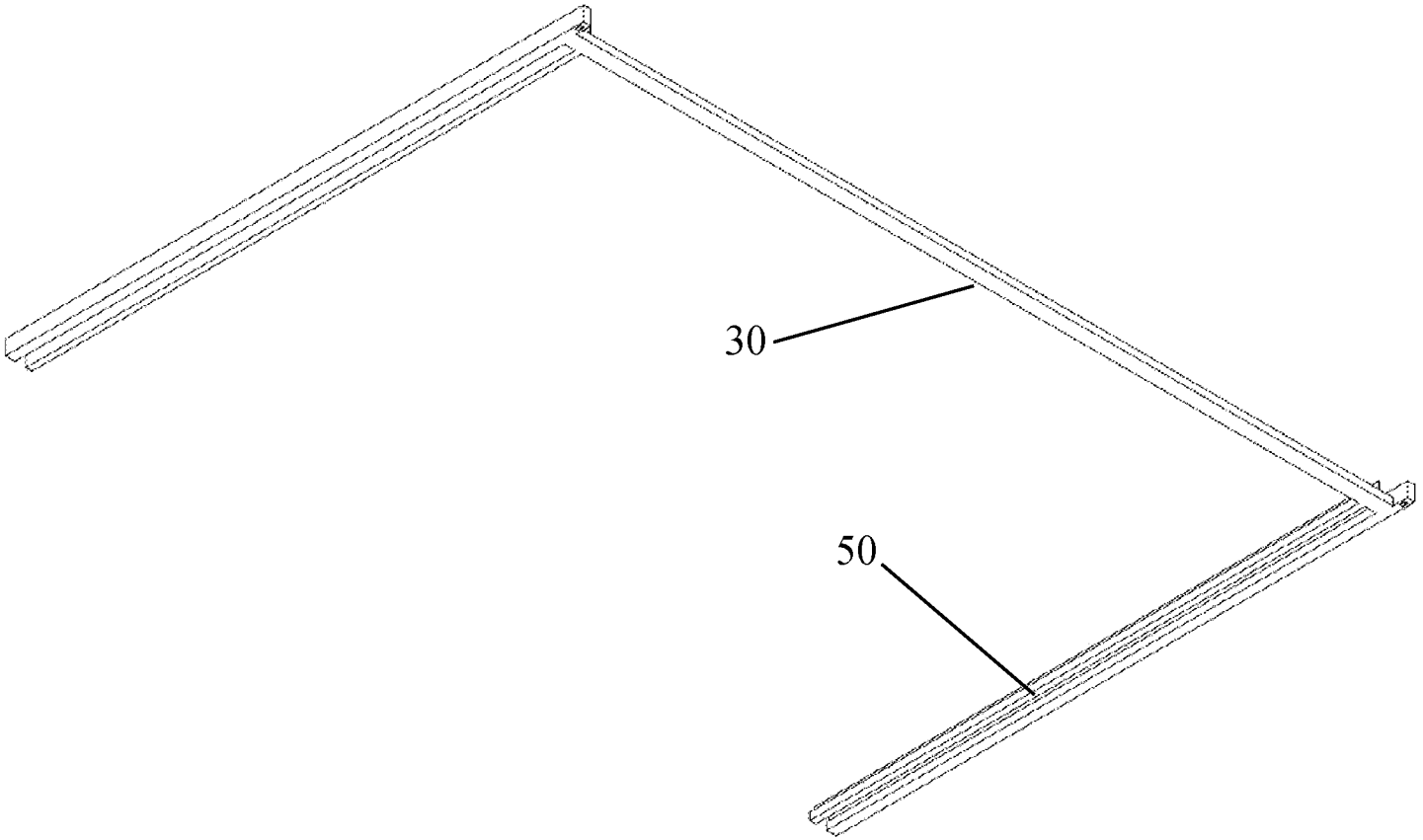
FIG. 9 illustrates a perspective view of a floor seal member of the pool enclosure of FIG. 1A.
Figure 10A:
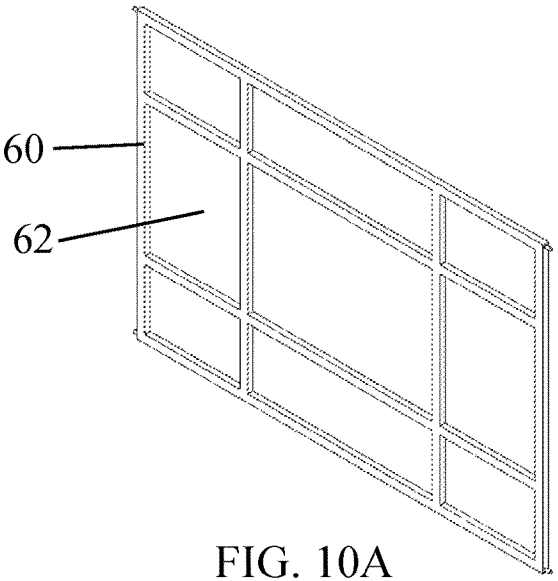
FIG. 10A illustrates a perspective view of a pool cover slidable to cover a surface of a pool, according to an exemplary embodiment of the present invention.
Figure 10D:
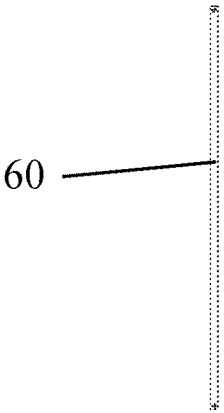
FIG. 10D illustrates a front view of the pool enclosure of FIG. 10A.
Figure 10B:
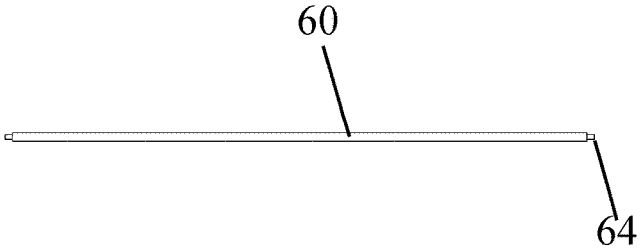
FIG. 10B illustrates a top view of the pool enclosure of FIG. 10A.
Figure 10C:
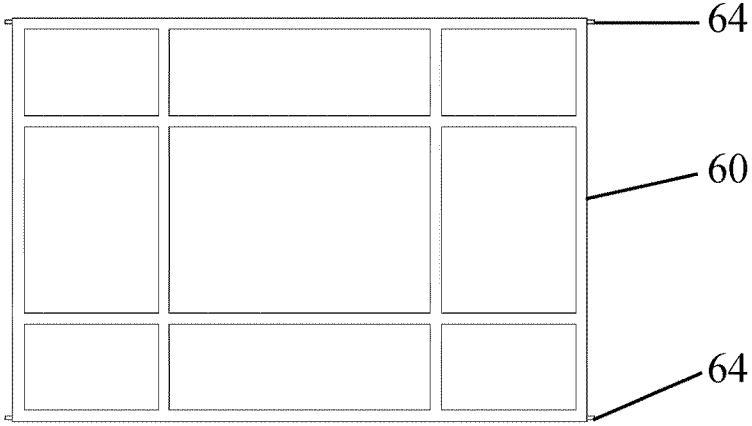
FIG. 10C illustrates a side view of the pool enclosure of FIG. 10A.

FIG. 9 shows the floor seal under the outer wall and the side walls that help close the gap between the walls and the floor near the pool. The seal can include one or more wheels under it, on both sides, allowing it to slide along the floor near the pool.

FIGS. 10A through 10D show a glass cover for placement on the pool. The cover can provide a temporary floor when the user does not want to use the pool but wants the area to be covered by the expandable structure. It also can prevent too much water vapor evaporating from the pool and damaging the structure when it is not used. It can also be used when the pool is outdoor to prevent dirt and leaves from falling into the pool.

Referring back to FIGS. 1A through 5, a pool enclosure 10 can include opposing sides walls 22 that, in the expanded state, extend from a structure, such as a home 20, to form sides of the pool enclosure 10. Distal the home 20, an outer wall 24 can span between the side walls 22 to form a front 14 of the pool enclosure 10. A roof 18 can cover the pool enclosure. When in the expanded state, such as in FIGS. 1A through 1D, the pool enclosure 10 can cover a pool 16, such as an in ground pool as illustrated. Of course, the pool enclosure 10 may be used to cover any surface or structure, such as a spa, for example.

When in the retracted states, as shown in FIGS. 2A through 2D, the roof 18 may be disposed to cover the outer wall 24. Typically, the roof 18 may extend vertically, or slightly angled, such as at an angle less than 10 degrees, when in the retracted state.

Figure 4:
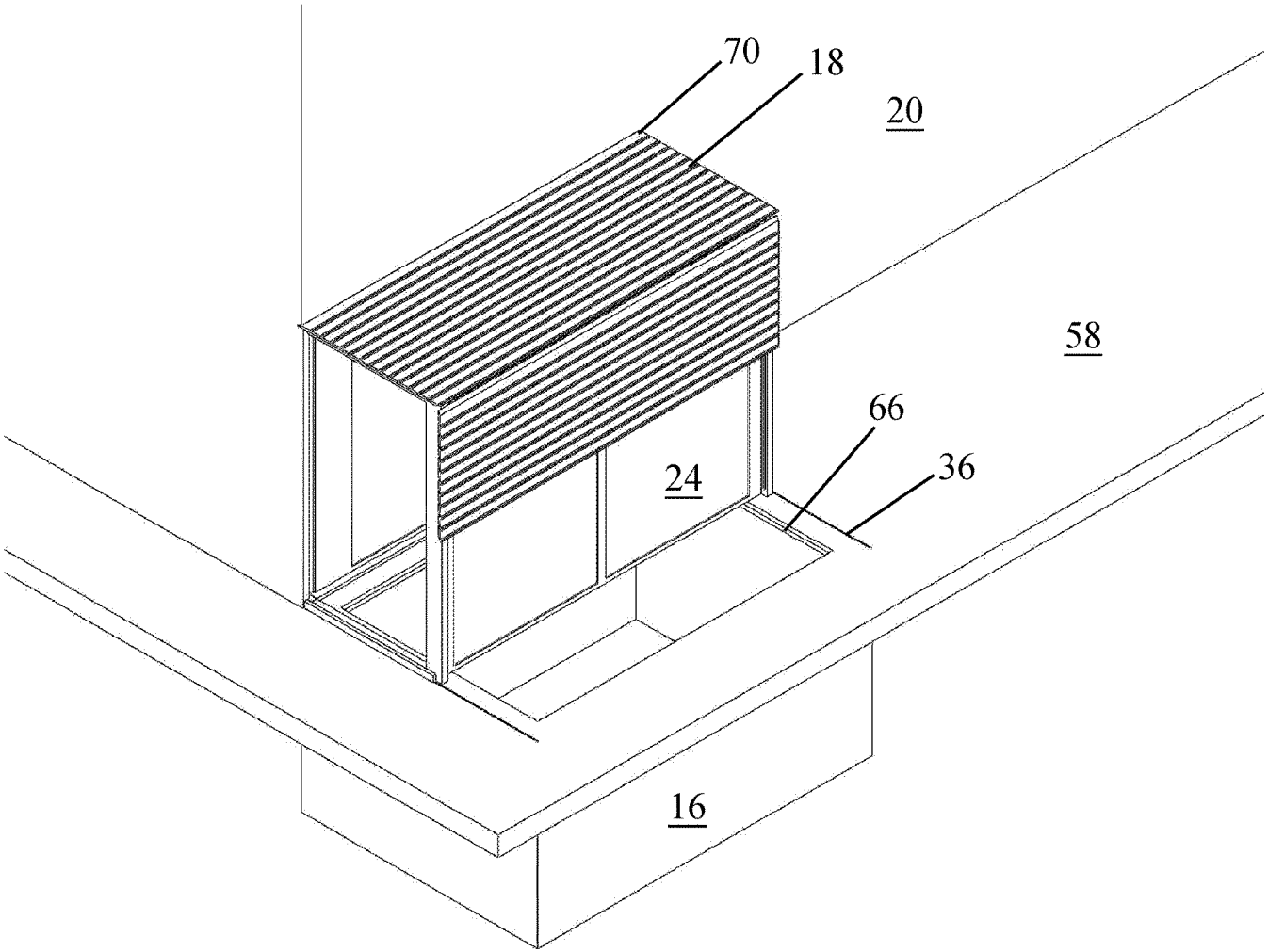
FIG. 4 illustrates a perspective view of a pool enclosure moving between the retracted state, as shown in FIG. 2A, and the expanded state, as shown in FIG. 1A.
Figure 5:
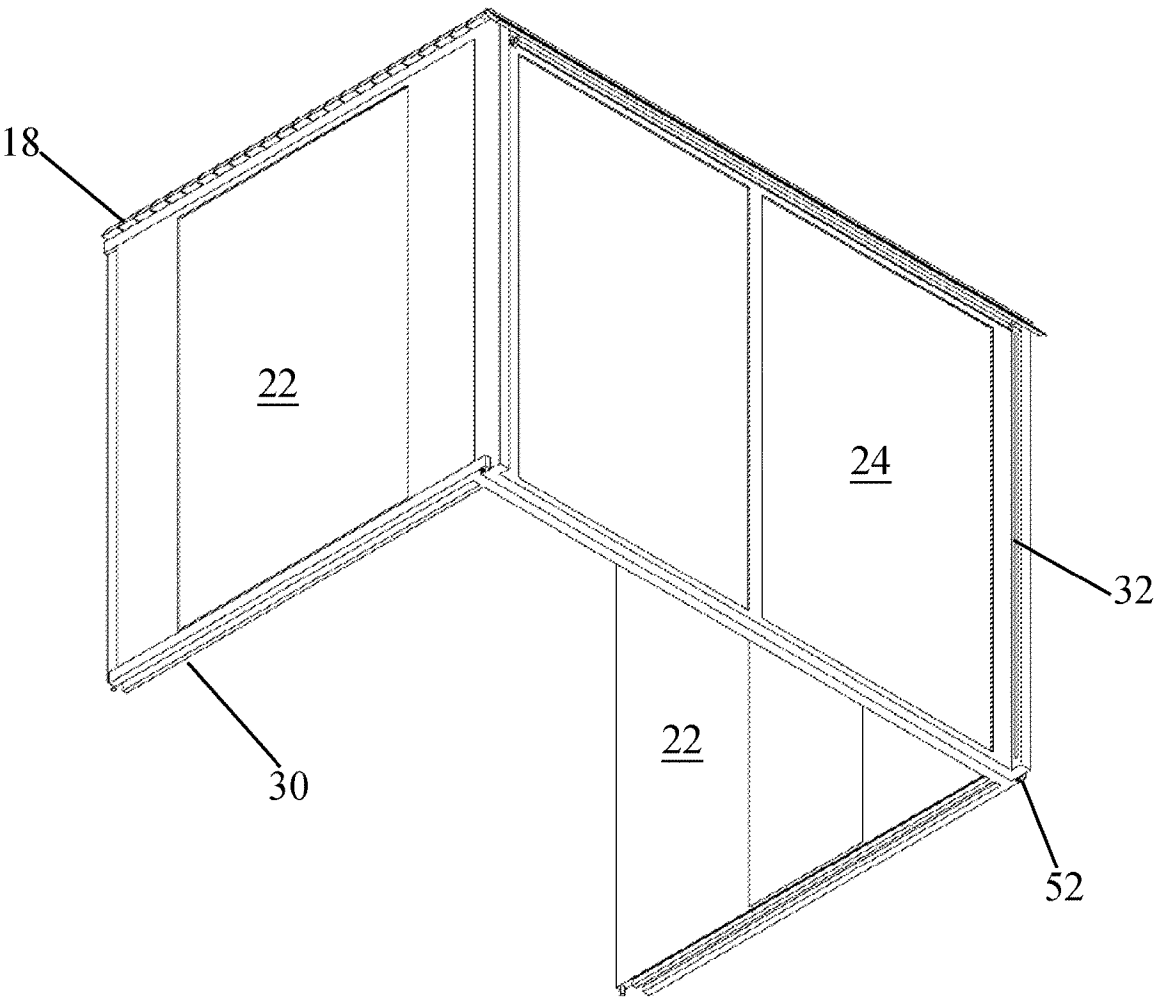
FIG. 5 illustrates a bottom perspective view of the pool enclosure of FIG. 1A, with the home structure removed for clarity.
Figure 6A:
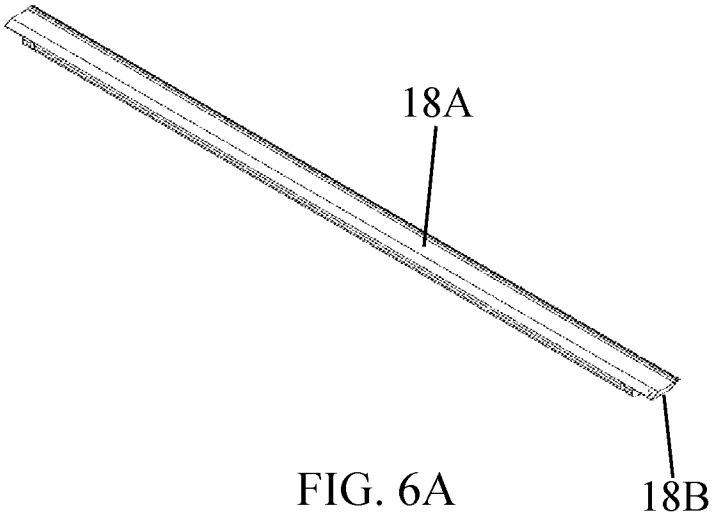
FIG. 6A illustrates a perspective view of an individual roof panel used in the pool enclosure of FIG. 1A, according to an exemplary embodiment of the present invention.
Figure 6D:
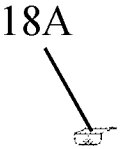
FIG. 6D illustrates a front view of the roof panel of FIG. 6A.
Figure 6B:
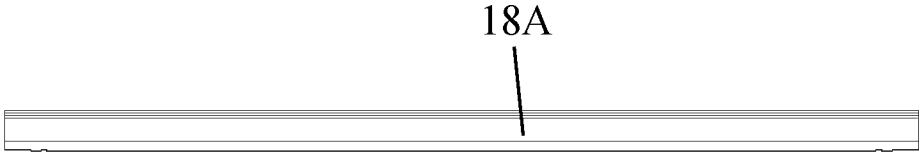
FIG. 6B illustrates a top view of the roof panel of FIG. 6A.
Figure 6C:
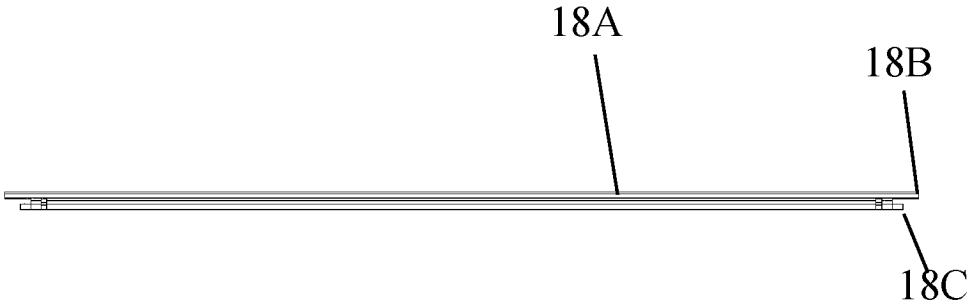
FIG. 6C illustrates a side view of the roof panel of FIG. 6A.
Figure 7A:
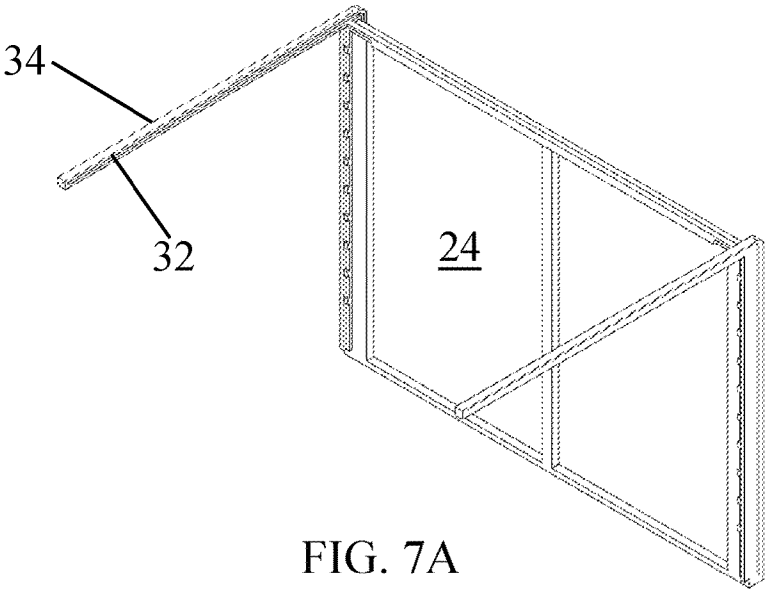
FIG. 7A illustrates a perspective view of a movable outer wall of the pool enclosure of FIG. 1A, according to an exemplary embodiment of the present invention.
Figure 7D:
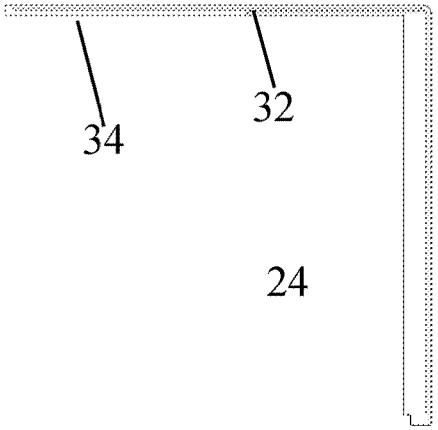
FIG. 7D illustrates a front view of the movable outer end wall of FIG. 7A.
Figure 7B:
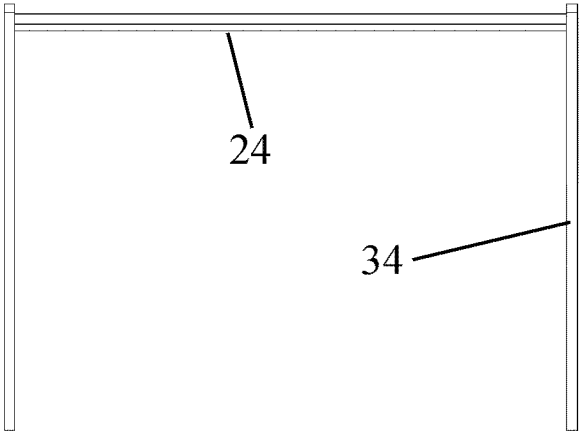
FIG. 7B illustrates a top view of the movable outer end wall of FIG. 7A.
Figure 7C:
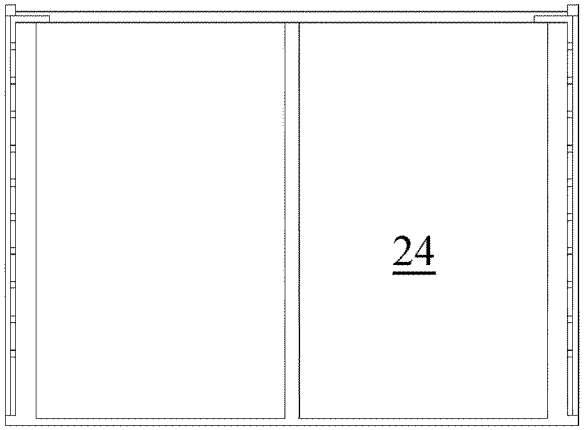
FIG. 7C illustrates a side view of the movable outer end wall of FIG. 7A.
Figure 8A:
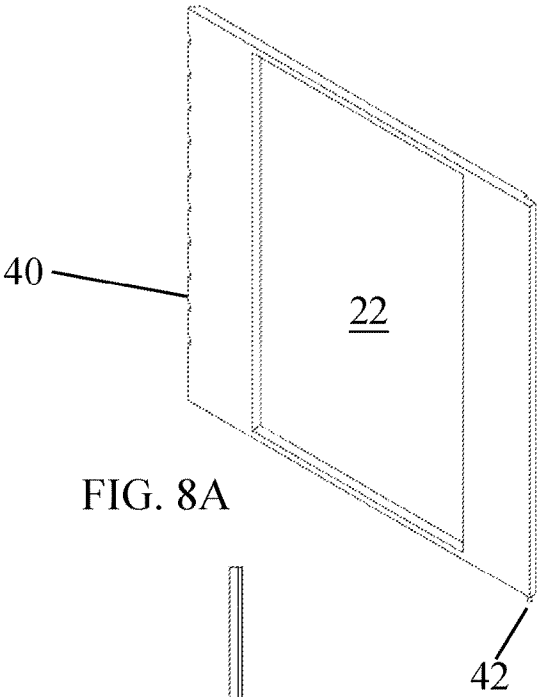
FIG. 8A illustrates a perspective view of a pivoting side wall of the pool enclosure of FIG. 1A, according to an exemplary embodiment of the present invention.
Figure 8D:
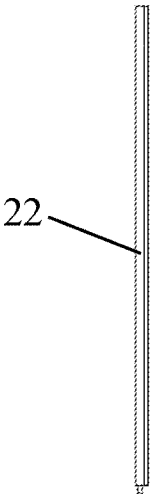
FIG. 8D illustrates a front view of the side wall of FIG. 8A.
Figure 8B:
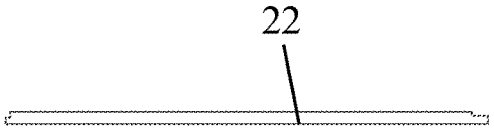
FIG. 8B illustrates a top view of the side wall of FIG. 8A.
Figure 8C:
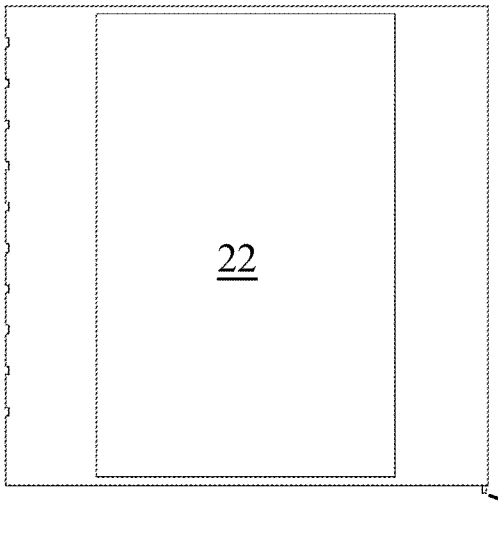
FIG. 8C illustrates a side view of the side wall of FIG. 8A.

During expansion, such as can be seen in FIG. 4, the outer wall 24 may be moved, along with a floor sealing member 30. The floor sealing member 30 may form a seal between the patio 58 and the outer wall 24 and the side walls 22. In some embodiments, the floor sealing member 30 can include one or more wheels 52 on each side thereof that may move along a surface of a patio 58 surrounding the pool 16. In some embodiments, the patio 58 may include grooves 36 for guiding the wheels 52.

As the outer wall 24 and floor sealing member 30 are moved outward away from the home 20, the roof 18 may have an end panel 70 attached to the home 20, so that the roof 18 may roll up tracks 32 formed in the outer wall 24. These tracks 32 may turn about 90 degrees to continue on tracks 32 in arms 34 of the outer wall 24 (see FIGS. 7A through 7D, for example). As shown in FIGS. 6A through 6D, the roof 18 may be made from a plurality of roof panels 18A, each pivotably connected so that the roof 18 may make the bend on the track 32 to move from a generally vertical position (in the retracted state) to a covering over the pool enclosure 10 in the expanded state. The roof panels 18A may include pins 18C that move along the track 32. Further, the roof panels 18B may include an overhang portion 18B to help prevent, for example, wind-blown rain from entering the pool enclosure.

Once the outer wall 24 is fully expanded, the side walls 22 may be pivoted, as described below, to extend between the home 20 and the outer wall 24. The side walls 22 may also engage to seal with the floor sealing member 30.

Referring to FIGS. 8A through 8D, the side walls 22 may pivot on a pivot pin 42 that may attach to a bracket formed in or attached to the home 20. The front edge 40 of the side walls 22 may be formed in a pattern to mate with the outer wall 24 and provide a positive engagement therewith.

Referring to FIG. 9, the floor sealing member 30, as described above, may include one or more wheels 52 on each side thereof to help move the floor sealing member 30 along the patio 58 during expansion and retraction of the pool enclosure 10. A track 50 may be formed in the sides of the floor sealing member 30 to permit the floor sealing member 30 to slide outward from the home 20 and to mate with the side walls 22.

Referring also to FIGS. 10A through 10D, a pool cover 60 may provide a frame for cover members 62, such as panels of metal, wood, glass, composite, or the like, that may be used to provide a surface over the pool 16, essentially providing additional patio space. In some embodiments, the pool cover 60 may include pins 64 that can move along a channel 66 (see FIGS. 2A and 4) formed on inside side walls of the pool. The channel 66 may be disposed a depth into the pool so that the floor surface provided by the pool cover 60 may be flush with the remainder of the patio 58.

In some embodiments, the pins 64 may extend outward from the pool cover 60, where the pins 64 may slide along the track 50 in the floor sealing member 30 so that the pool cover 60 may move outward with the floor sealing member 30. In some embodiments, the pool cover 60 may include wheels (not shown) on the pins 64 that can move along the groove 36 in the patio 58 (see FIG. 2A) to permit deployment of the pool cover 60. In some embodiments, the pool cover 60 may be deployed with or without the pool enclosure 10.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A foldable enclosure extendable from a structure, comprising:

an outer wall slidable away from the structure to move the outer wall into an expanded state;

first and second side walls, pivotably attached at the structure, the first and second side walls mating with the outer wall in the expanded state; and a roof, disposed to cover at least a portion of a front face of the outer wall in a folded state, the roof moving to cover an interior of the foldable enclosure as the outer wall is moved away from the structure toward the expanded state;

a pivot pin formed on a first side of each of the first and second side walls, the pivot pin permitting the first and second side walls to pivot relative to the structure; and a patterned edge formed along the second side of each of the first and second side walls, the patterned edge mating with the outer wall when the foldable structure is in the expanded state.

2. The foldable enclosure of claim 1, further comprising a floor sealing member extendable from the structure, the floor sealing member providing a seal between a surface and the outer wall and the first and second side walls.

3. The foldable enclosure of claim 2, wherein the floor sealing member includes at least one wheel on each side thereof, the at least one wheel guiding the floor sealing member along the surface.

4. The foldable enclosure of claim 3, wherein the at least one wheel moves along a groove formed in the surface.

5. The foldable enclosure of claim 1, wherein the foldable enclosure covers a pool or spa in the expanded state.

6. The foldable enclosure of claim 1, wherein, in the folded state, the first and second side walls fold to be coplanar with, adjacent to and covered by the outer wall.

7. The foldable enclosure of claim 1, wherein the outer wall includes first and second tracks, each extending vertically along opposing sides of the outer wall, the first and second tracks extending along extension arms extending rearward from a front of the outer wall.

8. The foldable enclosure of claim 7, wherein the roof has a plurality of roof panels, a first one of the roof panels being attached to the structure, a remainder of the plurality of roof panels movable along the first and second tracks as the foldable enclosure is moved between the folded state and the extended state.

9. The foldable enclosure of claim 7, wherein the plurality of roof panels include an overhand portion extending beyond the first and second side walls when the foldable enclosure is in the extended state.

10. The foldable enclosure of claim 1, further comprising a pool cover extendable from the structure to form a floor surface adjacent the structure.

11. The foldable enclosure of claim 10, wherein the floor surface covers an in ground pool to permit users to walk on the floor surface when not using the in ground pool.

12. The foldable enclosure of claim 11, wherein the floor surface is extendable from the structure either along with expansion of the foldable enclosure into the expanded state, or without expanding the foldable enclosure into the expanded state.

13. A foldable enclosure extendable from a structure to enclose a pool or spa, comprising:

an outer wall slidable away from the structure to move the outer wall into an expanded state;

first and second side walls, pivotably attached at the structure, the first and second side walls mating with the outer wall in the expanded state;

a roof, disposed to cover at least a portion of a front face of the outer wall in a folded state, the roof moving to cover an interior of the foldable enclosure as the outer wall is moved away from the structure toward the expanded state; and a floor sealing member extendable from the structure, the floor sealing member providing a seal between a surface and the outer wall and the first and second side walls, wherein the outer wall includes first and second tracks, each extending vertically along opposing sides of the outer wall, the first and second tracks extending along extension arms extending rearward from a front of the outer wall.

14. The foldable enclosure of claim 13, wherein the roof has a plurality of roof panels, a first one of the roof panels being attached to the structure, a remainder of the plurality of roof panels movable along the first and second tracks as the foldable enclosure is moved between the folded state and the extended state.

15. The foldable enclosure of claim 13, wherein the floor sealing member includes at least one wheel on each side thereof, the at least one wheel guiding the floor sealing member along the surface.

16. The foldable enclosure of claim 15, wherein the at least one wheel moves along a groove formed in the surface.

17. A foldable enclosure extendable from a structure to enclose a pool or spa, comprising:

an outer wall slidable away from the structure to move the outer wall into an expanded state;

first and second side walls, pivotably attached at the structure, the first and second side walls mating with the outer wall in the expanded state;

a roof, disposed to cover at least a portion of a front face of the outer wall in a folded state, the roof moving to cover an interior of the foldable enclosure as the outer wall is moved away from the structure toward the expanded state;

a floor sealing member extendable from the structure, the floor sealing member providing a seal between a surface and the outer wall and the first and second side walls; and a pool cover extendable from the structure to form a floor surface over the pool or spa, adjacent the structure, to permit users to walk on the floor surface when not using the pool or spa.

18. The foldable enclosure of claim 17, wherein the floor surface is extendable from the structure either along with expansion of the foldable enclosure into the expanded state, or without expanding the foldable enclosure into the expanded state.

19. The foldable enclosure of claim 17, wherein:

the floor sealing member includes at least one wheel on each side thereof, the at least one wheel guiding the floor sealing member along a patio surface; and the at least one wheel moves along a groove formed in the patio surface.

* * * * *